US006327938B1

(12) United States Patent
Pietras

(10) Patent No.: US 6,327,938 B1
(45) Date of Patent: Dec. 11, 2001

(54) JAW UNIT FOR USE IN A POWER TONG

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/355,905

(22) PCT Filed: Jan. 15, 1998

(86) PCT No.: PCT/GB98/00129

§ 371 Date: Aug. 5, 1999

§ 102(e) Date: Aug. 5, 1999

(87) PCT Pub. No.: WO98/35127

PCT Pub. Date: Aug. 13, 1998

(30) Foreign Application Priority Data

Feb. 7, 1997 (GB) ..... 9702474

(51) Int. Cl.[7] ..... B25B 13/50

(52) U.S. Cl. ..... 81/57.33; 81/57.14; 81/57.15; 81/57.2; 81/57.34

(58) Field of Search ..... 81/57.14, 57.15, 81/57.16, 57.18, 57.2, 57.21, 57.33, 57.34

(56) References Cited

U.S. PATENT DOCUMENTS

| | | | |
|---|---|---|---|
| 2,550,045 | 4/1951 | DeHetre | 81/57.18 |
| 2,703,221 | 3/1955 | Gardner | 81/57.18 |
| 3,019,680 | 2/1962 | Daugherty et al. . | |
| 3,023,651 | 3/1962 | Wallace | 81/57 |
| 3,261,241 | 7/1966 | Catland | 81/57.18 |
| 3,747,675 | 7/1973 | Brown | 166/237 |
| 3,875,826 | 4/1975 | Dreyfuss et al. | 81/57.18 |
| 3,892,140 | 7/1975 | Fox et al. | 74/224 |
| 4,084,453 | 4/1978 | Eckel | 81/57.18 |
| 4,401,000 | 8/1983 | Kinzbach | 81/57.2 |
| 4,437,363 | 3/1984 | Haynes . | |
| 4,688,453 | 8/1987 | Schulze-Beckinghausen | 81/57.18 |
| 4,709,599 | 12/1987 | Buck | 81/57.18 |
| 4,739,681 | 4/1988 | Pietras | 81/57.16 |
| 5,044,232 | 9/1991 | Schulze-Beckinghausen | 81/57.18 |
| 5,161,439 | 11/1992 | Wesch, Jr. | 81/57.33 |
| 5,207,128 | 5/1993 | Albright . | |
| 5,259,275 | 11/1993 | Schulze-Beckinghausen | 81/57.16 |
| 5,435,213 | 7/1995 | Buck | 81/57.18 |
| 5,839,330 | 11/1998 | Stokka | 81/57.33 |

FOREIGN PATENT DOCUMENTS

| | | |
|---|---|---|
| 0082098 | 11/1982 | (EP) . |
| 0170195 | 7/1985 | (EP) . |
| 578972 | 4/1944 | (GB) . |
| 981569 | 7/1962 | (GB) . |
| 1226857 | 9/1968 | (GB) . |
| 1348954 | 3/1972 | (GB) . |
| 1448757 | 8/1974 | (GB) . |
| 2100639 | 6/1982 | (GB) . |

*Primary Examiner*—Timothy V. Eley
*Assistant Examiner*—Willie Berry, Jr.
(74) *Attorney, Agent, or Firm*—Moser, Patterson & Sheridan, LLP

(57) ABSTRACT

A jaw unit (102) for use in a tong which comprises a jaw holder (105) and a jaw (106) movable with respect to said jaw holder (105), characterised in that said jaw (106) is slidably mounted on said jaw holder (105).

10 Claims, 4 Drawing Sheets

JAW UNIT FOR USE IN A POWER TONG

This invention relates to a rotary for use in a tong, and a tong fitted with such a rotary.

During the construction of oil and gas wells it is necessary to connect and disconnect a large number of threaded tubulars, for example lengths of casing and drill pipe. This is generally effected by means of a tong which is a device which grips the tubular. The tubular is then rotated either by rotating the tong manually or, more usually by a hydraulic motor.

The cost of running a drilling rig is extremely high and consequently there is tremendous pressure to develop tools which can be operated more rapidly than previous tools. It is also important that such tools are reliable even under the extreme environmental conditions where drilling often takes place.

U.S. Pat. No. 4,437,363 discloses a rotary for use in a tong, comprising a casing having an opening for entry and removal of a tubular in a radial direction and having a peripheral wall, cams on an inner face of the peripheral wall, first and second jaw holders supported in the casing for guidance by the cams and for rotation between positions where they converge for gripping the tubular and positioned where they diverge for release of the tubular, and first and second jaws slidably mounted on the jaw holders.

The invention is characterised in that in a divergent position of the jaw holders the first and second jaws are slidable by contact with the tubular along arcuate paths between first positions in which the tubular is insertable into and removable from the rotary and second positions where they surround and can grip the tubular.

Advantageously, said jaw has a gripping surface which is substantially arcuate for gripping the surface of a tubular and the centre of curvature of such arcuate path lies between the centre of curvature of said gripping surface and said arcuate path. The gripping surface may be a continuous surface or defined by several spaced apart gripping elements. Jaws having arcuate gripping surfaces are disclosed for power tongs in WO 94/01249.

Preferably, the centre of curvature of said arcuate path lies between the centre of curvature of said gripping surface and said gripping surface. Advantageously, the centre of curvature of said arcuate path is substantially midway between the centre of curvature of said gripping surface and said gripping surface. Preferably, one of said jaw and said jaw holder is provided with an arcuate track which defines said arcuate path, and the other of said jaw and said jaw holder is slidably mounted in said arcuate track.

There may be provided a jaw assembly comprising two jaw units in accordance with the present invention. Preferably, said jaw units are mounted for pivotal movement about a common pivot shaft. Advantageously, said jaw assembly includes means which bias said jaw units apart.

The present invention also provides a tong fitted with a rotary in accordance with the present invention.

Traditionally, a rotary is made from three separate pieces, i.e. a top section, a bottom section and a peripheral wall. Each section has to be carefully made and machined to ensure that all three sections can be bolted together. This involves considerable skilled work and consequently a rotary is a relatively expensive item. In order to help overcome this problem, the rotary may be formed as a one piece casting.

One of the features of existing tongs is that their rotaries are difficult to furnish. Thus, routine maintenance usually involves dismantling the whole rotary, checking the parts and reassembling the whole. Whilst this is a straightforward procedure in the clean conditions of a workshop it can be problematic when carried out in a muddy field, in sand or in snow. In order to help solve this problem a rotary may be provided which comprises a top section, a bottom section, and a peripheral wall therebetween, characterised in that at least one of said top section and said bottom section is provided with an elongate slot which, when said rotary is in use, accommodates a pivot shaft on which a jaw assembly can be pivotally mounted.

Jaw holders and jaws for tongs are traditionally machined from the solid. This is a comparatively expensive procedure, and in the present invention may be made from a stack of individually cut laminations.

Conveniently, the laminations could be cut with a laser from sheet steel. The stack of laminations could then, for many purposes, be simply welded together along their sides and/or bolted together and/or glued together. Mass produced laminations are relatively inexpensive and an acceptable final product can be produced at a fraction of the cost of a product machined from the whole.

For a better understanding of the present invention reference will now be made, by way of example, to the accompanying drawings, in which.

Figure 1:
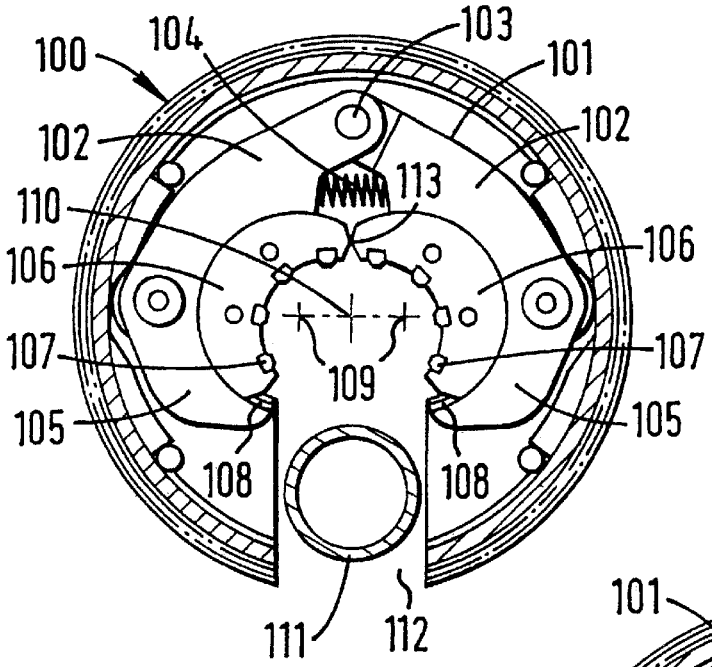
FIG. 1 is a schematic plan view, partly in section, showing a rotary fitted with a jaw assembly in accordance with the present invention ready to receive a tubular.

Referring to FIGS. 1 to 7 of the drawings there is shown a rotary which is generally identified by the reference numeral 100.

The rotary 100 is fitted with a jaw assembly 101 which comprises two jaw units 102 which are pivotally mounted on a pivot shaft 103 and which are biased apart by a spring 104.

Each jaw unit 102 comprises a jaw holder 105 on which is mounted a jaw 106 the radially inner surface of which is provided with a plurality of gripping elements 107 which together define a gripping surface which is substantially arcuate.

The jaw holders 105 are provided with an arcuate track 108 and the jaw 106 is slidably mounted on the arcuate track 108 so that the jaws 106 can slide along the arcuate track 108 relative to the jaw holder 105.

Thus, when the jaw holders 105 are in the position shown in FIGS. 1 to 7 the jaws 106 can slide along an arcuate path having a centre of curvature at a point 109 which is radially inwardly of the gripping surface of the gripping elements 107 but to one side of the centre 110 of the rotary 100.

In use, when it is desired to grip a tubular 111, for example a length of casing, the tubular 111 is introduced into the rotary 100 through the opening 112. This is shown in FIG. 1. It should be noted that the jaws 106 have been displaced to a position where they touch one another at point 113. This position can be achieved by displacing the jaws 106 manually. However, in practice the jaws 106 will normally be found in this position as a result of the exit of the previous tubular as will be described more fully hereinafter.

Figure 2:
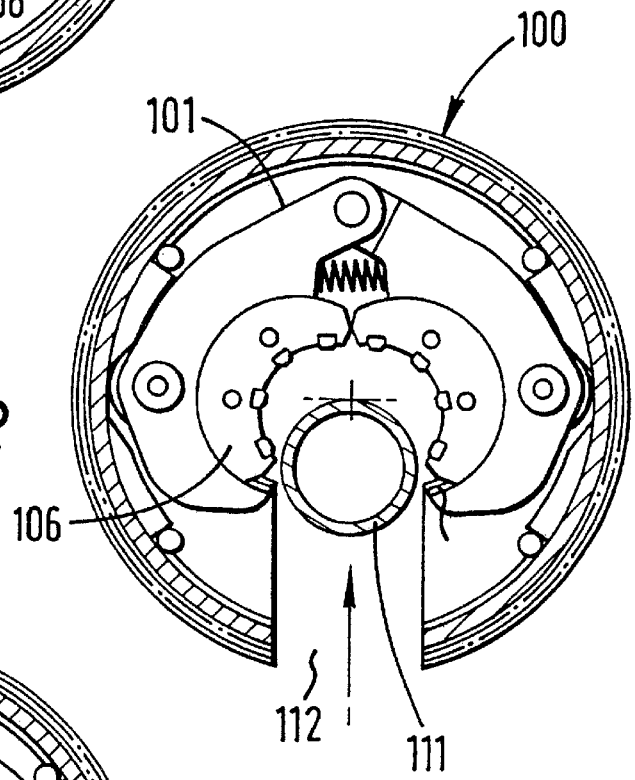
FIG. 2 shows the tubular entering the jaw assembly.

FIG. 2 shows the tubular 111 entering the jaw assembly 101, it will be noted that part of the arcuate track 108 is visible.

Figure 3:
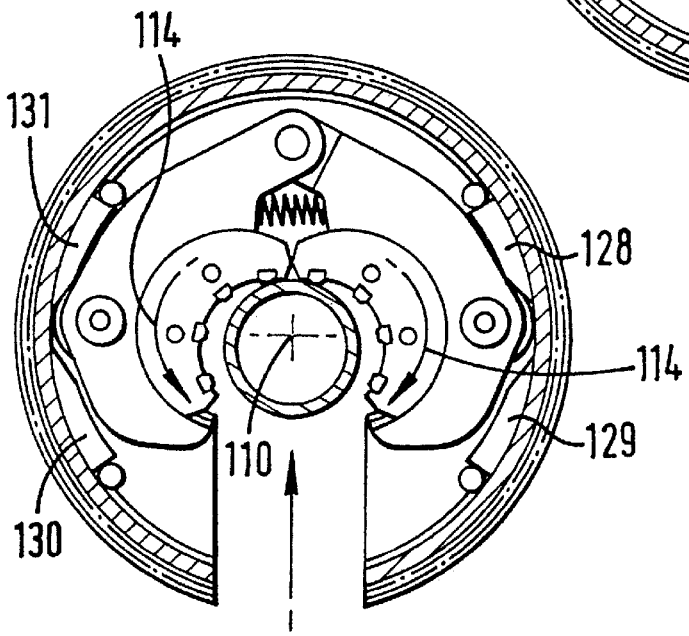
FIG. 3 shows the tubular nearing its final position in the jaw assembly.
Figure 4:
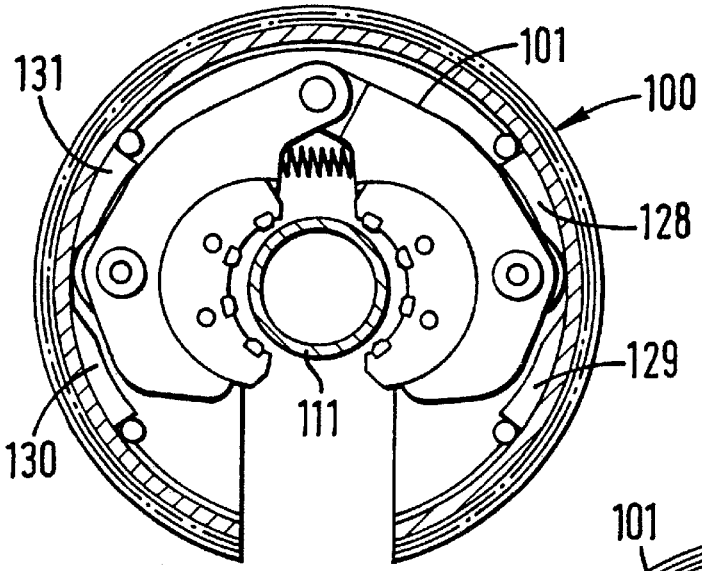
FIG. 4 shows the tubular in its final position.
Figure 5:
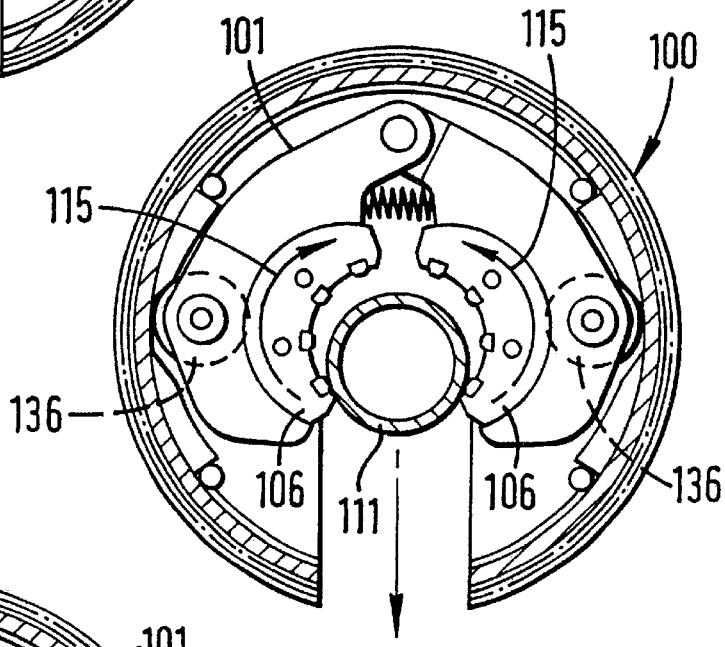
FIG. 5 shows the tubular being released from the jaw assembly.
Figure 6:
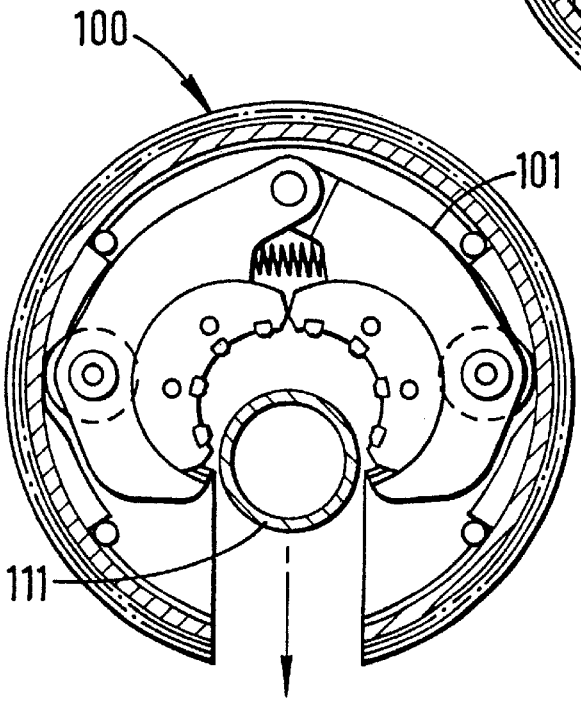
FIG. 6 shows the tubular leaving the jaw assembly.

FIG. 3 shows the tubular 111 contacting the jaws 106. As the tubular 111 is further advanced towards the centre 110 of the rotary 100 the jaws 106 are displaced in the direction of the arrows 114 until they come to rest in the position shown in FIG. 4. It will be noted that the arcuate track 108 is no longer visible.

The rotary 100 is then rotated clockwise (as viewed in FIG. 4) to advance the jaws 106 into gripping engagement with the tubular 111 as will be described hereinafter. The gripping surface substantially conforms to the surface of the tubular 111 and thus has a centre of curvature at the centre 110 of the rotary 100 when the jaws 106 are applied. After the tubular 111 has been rotated and tightened to the required torque the rotary 100 is rotated anti-clockwise to allow the jaws 106 to move away from the tubular 111 under the influence of spring 104.

The tubular 111 is then moved towards the opening 112. As it moves it engages the jaws 106 and displaces them in the direction of the arrows 115 so that they occupy the position shown in FIG. 6 which is identical to FIGS. 1, 2 and 7.

Figure 7:
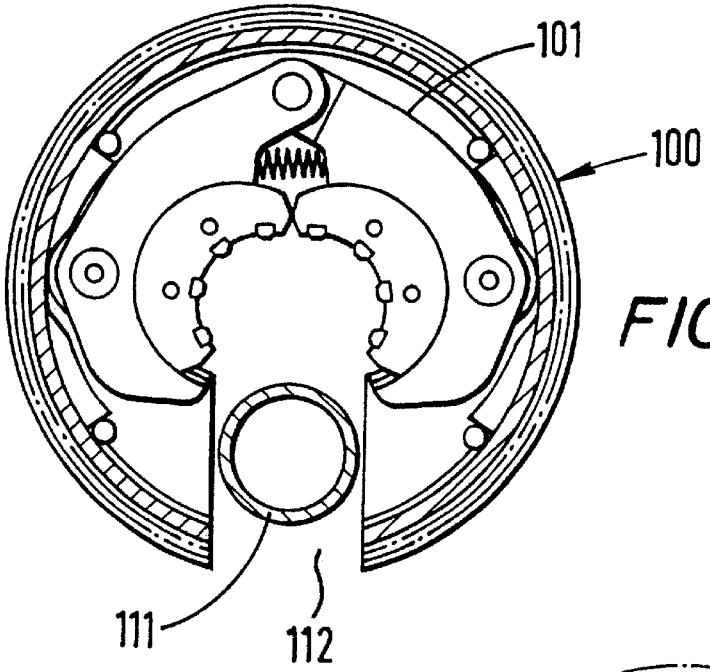
FIG. 7 shows the tubular leaving the rotary.

FIG. 7 shows the tubular 111 leaving the rotary 100.

It will be appreciated that the Jaw assembly 101 is extremely simple, quick to use and relatively inexpensive to manufacture and maintain.

Figure 8:
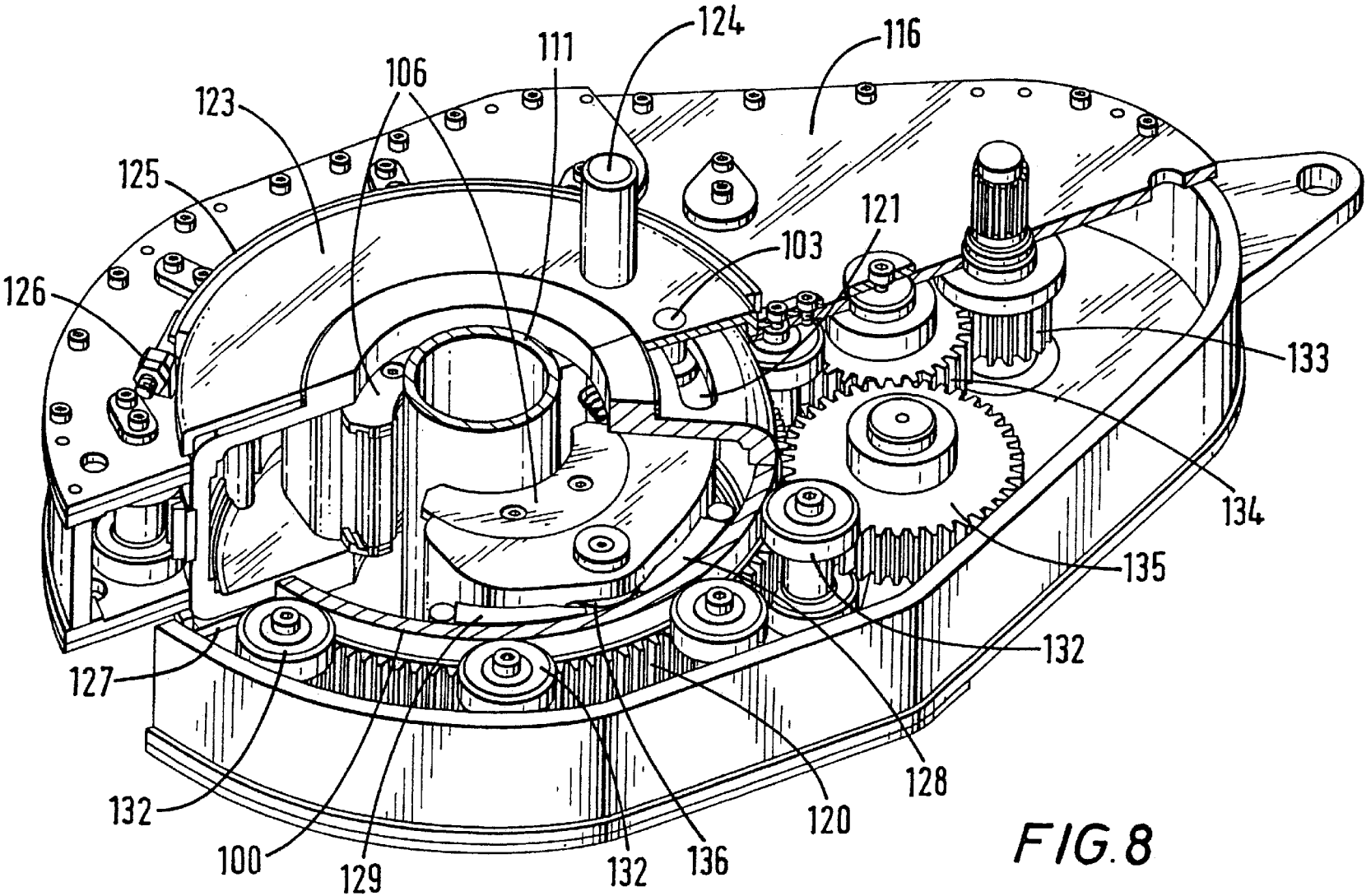
FIG. 8 is a perspective view, with part cut away, showing a tong in accordance with the present invention.

Referring now to FIG. 8, the rotary 100 is shown fitted in a tong 116.

Figure 9:
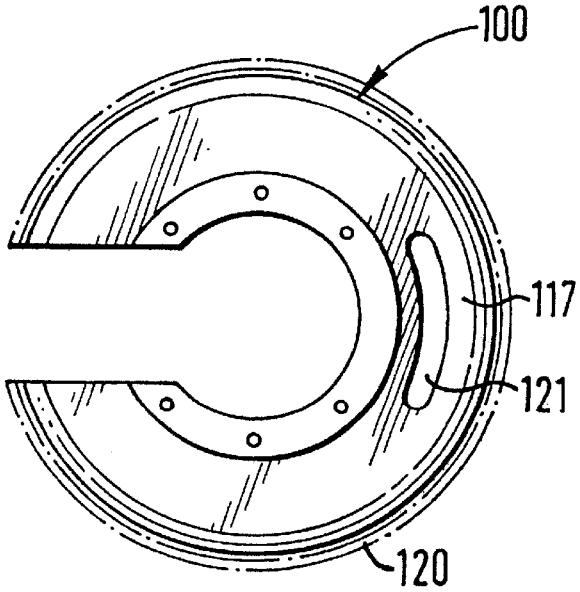
FIG. 9 is a top plan view of the rotary which forms part of the tong shown in FIG. 8.
Figure 10:
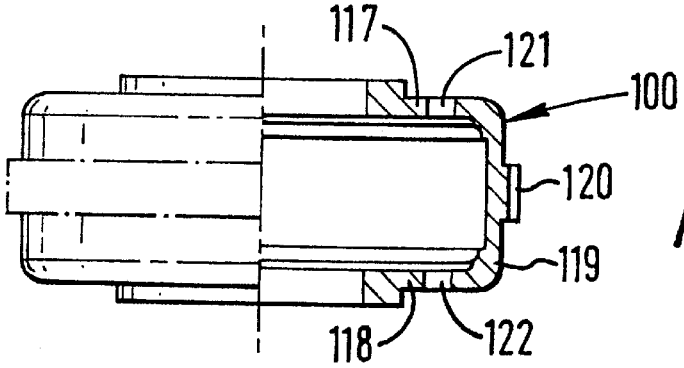
FIG. 10 is a side view, partly in cross-section and partly in elevation, showing the rotary of FIG. 9.

As shown in FIGS. 9 and 10, the rotary 100 is formed as a one piece casting which comprises a top section 117, a bottom section 118, and a peripheral wall 119 on which is formed a toothed track 120.

Both the top section 117 and the bottom section 118 are provided with an elongate slot 121, 122 respectively. Each elongate slot 121, 122 has its centre of curvature on the centre of rotation of the rotary 100.

As can be seen from FIG. 8, the upper part of the pivot shaft 103 which forms the pivot point for the two Jaw units 102 projects upwardly through the elongate slot 121 whilst the lower part of the pivot shaft 103 projects downwardly through the elongate slot 122.

The upper part of the pivot shaft 103 is secured to a disk 123 which is provided with a handle 124.

A friction member 125 extends circumjacent the disk 123 and is held thereagainst by a tensioner 126.

A disk 127 similar to disk 123 is mounted below the rotary 100 and is also engaged by a second friction member similar to friction member 125.

As can be seen in FIG. 8 and FIGS. 1 to 7, the sides of the rotary 100 are provided with cams 128, 129, 130 and 13i which are screwed to the rotary 100. The rotary 100 is located in the tong 116 by nine guide rolls 132, five of which are visible in FIG. 8. The guide rolls 132 each have an upper and a lower roller which bears against the peripheral wall 119 of the rotary 100 above and below the toothed track 120 respectively.

The rotary 100 is driven by a hydraulic motor (not shown) which acts through a gear train which includes gear wheels 133, 134 and 135.

In FIG. 8 the tubular 111 is about to be gripped. (This corresponds to the position shown in FIG. 4.) The hydraulic motor (not shown) is actuated to rotate gear wheels 133, 134 and 135 which in turn rotate the rotary 100 in a clockwise direction. However, whilst the rotary 100 rotates the disk 123 is restrained by the friction member 125. The disk 123 in turn restrains the pivot shaft 103 and the jaw assembly 101. Because the jaw assembly 101 is restrained the jaw units 102 ride up on the cams 128, 130 which urge the jaws 106 into the tubular 111 until either the pivot shaft 103 engages the end of the elongate slot 121 (or the forces between the tubular 111, the jaw units 102 and the cams 128, 130 are sufficiently high) at which time the disk 123 rotates in unison with the rotary 100 against the friction member 125. It will be noted that because the centres of curvature of the gripping elements 107 and the arcuate track 108 do not coincide the jaw holders 105 do not spin around the jaws 106 although means to limit the sliding movement of the jaws 102 relative to their jaw holders 105 could be provided if desired.

When the tubular 111 has been tightened to the desired torque the hydraulic motor is reversed to rotate the rotary 100 anti-clockwise. The jaws 106 are normally firmly engaged in the tubular 111 and hence the rotary 100 rotates relative to the Jaw assembly 101 so that the Jaw holder 105 returns to the position shown in FIG. 8. Means may be provided to prevent the Jaw holders 105 engaging the cams 129 and 131.

It will be noted that the Jaw holders 105 are each provided with a roller 136 which engages the cams 128, 129, 130 and 131.

If it is desired to rotate the tubular 111 in the opposite direction then the rotary 100 is simply rotated in the opposite direction causing the rollers 136 to roll along the cams 129, 131.

It will be noted that the entire jaw assembly 101 can be removed from the rotary 100 by simply removing the pivot shaft 103 and withdrawing the Jaw units 102. The cams 128, 129, 130, 131 can then be readily replaced if desired and the Jaw units 102 refitted or replaced if desired. Such changes would generally be made when changing the diameter of the tubular being run.

What is claimed is:

1. A rotary for use in a tong, comprising: a casing defining an opening for entry and removal of a tubular in a radial direction and having a peripheral wall with an inner face;

cams on said inner face of said peripheral wall;

first and second jaw holders supported on said casing for guidance by said cams and for rotation between convergent positions where said first and second jaw holders converge for gripping the tubular and divergent positions where said first and second jaw holders diverge for release of the tubular; and first and second jaws slidably mounted on said first and second jaw holders;

wherein, in said divergent positions of said first and second jaw holders, said first and second jaws are slidable by contact with the tubular along arcuate paths between first positions in which the tubular is insertable into and removable from said rotary and second positions in which said jaws surround and are able to grip the tubular.

2. The rotary of claim 1 wherein said casing is a one piece casting.

3. The rotary of claim 1 further comprising a common pivot shaft and a jaw unit in said casing, said jaw unit comprising said first and second jaw holders mounted for pivotal movement about said common pivot shaft.

4. The rotary of claim 3 wherein said casing comprising a top section and a bottom section with said peripheral wall therebetween, at least one of said top and bottom sections defining an elongate slot which accommodates said common pivot shaft.

5. The rotary of claim 3 wherein said jaw unit comprises means for biasing the jaw holders apart.

6. The rotary of claim 1 wherein each of said jaws has a gripping surface which is substantially arcuate for gripping a surface of the tubular and which has a center of curvature, said arcuate path along which said jaw is slidable having a center of curvature which lies between said center of curvature of said gripping surface and said arcuate path.

7. The rotary of claim 6 wherein said center of curvature of said arcuate path lies between said center of curvature of said gripping surface and said gripping surface.

8. The rotary of claim 7 wherein said center of curvature of said arcuate path is substantially midway between said center of curvature of said gripping surface and said gripping surface.

9. The rotary of claim 1 wherein one of each said jaw and each said jaw holder is provided with an arcuate track each which defines said arcuate path, and the other of each said jaw and each said jaw holder is slidably mounted in said arcuate track.

10. A tong fitted with a rotary as claimed in claim 1.

* * * * *